United States Patent [19]

Fourre

[11] Patent Number: 4,847,883

[45] Date of Patent: Jul. 11, 1989

[54] SUPPORT FOR ROTARY TARGET OF X-RAY TUBES

[75] Inventor: Jacques Fourre, Soisy Sous Montmorency, France

[73] Assignee: Le Carbone Lorraine, Courbevoie, France

[21] Appl. No.: 7,093

[22] Filed: Jan. 27, 1987

[30] Foreign Application Priority Data

Jan. 30, 1986 [FR] France ..... 86 01647

[51] Int. Cl.[4] ..... H01J 35/10

[52] U.S. Cl. ..... 378/144; 378/143; 428/634; 428/665; 428/408

[58] Field of Search ..... 378/143, 144; 428/408, 428/634, 665

[56] References Cited

U.S. PATENT DOCUMENTS

| | | | |
|---|---|---|---|
| 2,979,814 | 4/1961 | Steinberg | 428/408 |
| 3,174,895 | 3/1965 | Gibson et al. | 428/408 |
| 3,821,581 | 6/1974 | Holland et al. | 378/144 |
| 3,900,751 | 8/1975 | Holland et al. | 378/144 |
| 4,189,658 | 2/1980 | Schleinkofer | 378/144 |
| 4,276,493 | 6/1981 | Srinivasa et al. | 378/144 |
| 4,279,952 | 7/1981 | Kodama et al. | 428/408 |
| 4,335,327 | 6/1982 | Waugh et al. . | |
| 4,344,012 | 8/1982 | Hübner et al. . | |
| 4,367,556 | 1/1983 | Hübner et al. | 378/144 |
| 4,392,238 | 7/1983 | Lersmacher et al. | 378/144 |
| 4,461,019 | 7/1984 | Lersmacher | 378/144 |
| 4,573,185 | 2/1986 | Lonnsberry et al. | 378/125 |
| 4,641,334 | 2/1987 | Devine, Jr. | 378/144 |

FOREIGN PATENT DOCUMENTS

| | | | |
|---|---|---|---|
| 2152049 | 4/1973 | Fed. Rep. of Germany . | |
| 2440988 | 3/1975 | Fed. Rep. of Germany | 378/144 |
| 2910138 | 9/1980 | Fed. Rep. of Germany | 378/144 |
| 2084124 | 4/1982 | United Kingdom . | |
| 2125208 | 2/1984 | United Kingdom | 378/144 |

OTHER PUBLICATIONS

"Graphite . . . a Refractory Material", advertisement by Le Carbone-Lorraine, 1981, France.

"Chemistry and Physics of Carbon", edited by Walker, Jr. et al., published by Macel Dekker, Inc. New York, 1973, pp. 87, 88, 106-107.

*Primary Examiner*—Janice A. Howell

*Assistant Examiner*—John C. Freeman

*Attorney, Agent, or Firm*—Dennison, Meserole, Pollack & Scheiner

[57] ABSTRACT

The present invention concerns a support of carbonaceous material for a rotary target of X-ray tubes. The support is formed of two parts which are fixed with respect to each other, one part being of a carbon/carbon composite which provides mechanical strength and the other part being of polycrystalline graphite for receiving a refractory metal, by virtue of its coefficient of expansion. A thermal contact is provided between the two parts. The invention is especially applicable to targets of X-ray tubes which rotate at a high speed, 20,000 RPM and above.

9 Claims, 5 Drawing Sheets

SUPPORT FOR ROTARY TARGET OF X-RAY TUBES

Figure 1:
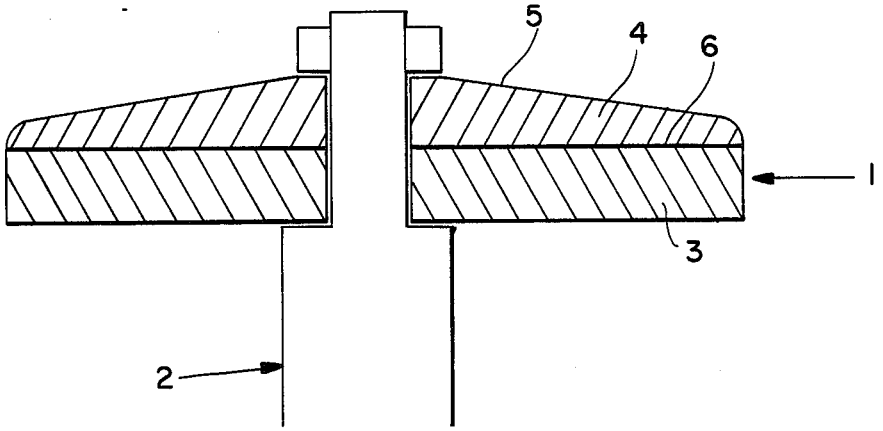

The present invention relates to a support for a rotary target of X-ray tubes, of the type comprising a disc formed by a support of carbonaceous material on which there is fixed or deposited a layer of refractory metal such as tungsten. The invention more particularly concerns a support for a target which rotates at high speed (20,000 revolutions per minute and higher).

In most cases, the carbonaceous material used for the support is selected from polycrystalline graphites whose coefficient of expansion is compatible with that of the refractory metal which is fixed (for example by brazing) or deposited (for example from the vapour phase) on the support.

The major disadvantage of such polycrystalline graphites is that they do not have an adequate level of mechanical strength once the speed of the target becomes considerable, for example 20,000 revolutions per minute.

It is known moreover that composite materials consisting of carbon fibres and a carbon matrix (referred to hereinafter as carbon/carbon composites) have a much higher level of mechanical strength than the above-mentioned polycrystalline graphites. It would therefore be possible to envisage using them as a support, the mechanical strength thereof preventing the disc from bursting under the effect of centrifugal force. However their coefficient of expansion is incompatible with that of the refractory metals which are generally used.

The main aim of the invention is to produce a support having both thermal characteristics compatible with those of the refractory metal selected, and a very high level of mechanical strength.

That aim is achieved according to the invention which comprises a support of carbonaceous material intended to receive a layer of refractory metal for a rotary target of X-ray tubes, the support being characterised in that it is formed by two parts which are fixed with respect to each other, one part being of carbon/carbon composite and the other being of polycrystalline graphite, the latter being intended to receive said refractory metal.

The two parts may be disposed one beneath the other, in superposed relationship, or one surrounding the other.

In the first case, the two parts may be:

either juxtaposed and mechanically fixed relative to each other by any suitable connecting process such as brazing, or vapour phase carbon infilitration, or engaged one into the other by a groove-and-tongue type connection or by interembedding, which makes them mechanically fixed together.

Thermal contact is ensured between the two parts by any suitable process: brazing, vapour phase carbon infiltration, insertion of metal or graphite in powder form, sheet of flexible graphite such as a sheet of PAPYEX (the applicants' registered trademark), etc.

In the second case, the part of composite material surrounds the part of polycrystalline graphite, like a belt. The support may be produced by a hooping operation.

The polycrystalline graphites are generally selected from those having the following characteristics:

relative density $> 1.8$ resistance to bending $> 40$ MPa coefficient of expansion between ambient temperature and 1000° C.: 4 to $6 \cdot 10^{-6}$/°C.

The carbon/carbon composites are generally selected from those having a substrate of cloth or felt with a density of fibres of higher than 0.5 and the following characteristics:

relative density $> 1.7$ resistance to bending $> 150$ MPa coefficient of expansion between ambient temperature and 1000° C.: 0.5 to $2 \cdot 10^{-6}$/°C.

FIGS. 1, 2, 3, 4 and 5 show views in section by way of non-limiting example of assemblies of targets comprising a support according to the invention.

Referring to FIG. 1, the assembly comprises a target 1 fixed to a rod 2. The support of the target is formed by a part 3 of carbon/carbon composite which is juxtaposed with a part of polycrystalline graphite as indicated at 4. The refractory metal at 5 is fixed on the latter. A braze 6 for example of titanium alloy fixes the two parts to each other and at the same time provides for thermal contact therebetween. Alternatively, the braze 6 may be replaced by vapour phase carbon infiltration.

Figure 2:
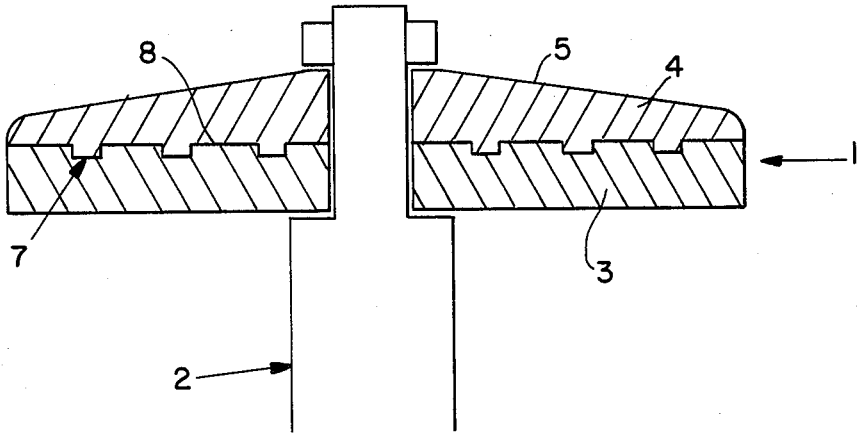

Referring to FIG. 2, the assembly comprises a target 1 fixed to a rod 2. The support for the target is formed by a part 3 of carbon/carbon composite, which is mechanically secured to a part 4 of polycrystalline graphite 4 by a groove-and-tongue connection 7. The refractory metal 5 is fixed on the part 4. Thermal contact between the two parts is provided by a braze or a metal in powder form such as for example zirconium or graphite in powder form, etc. (reference 8).

Figure 3:
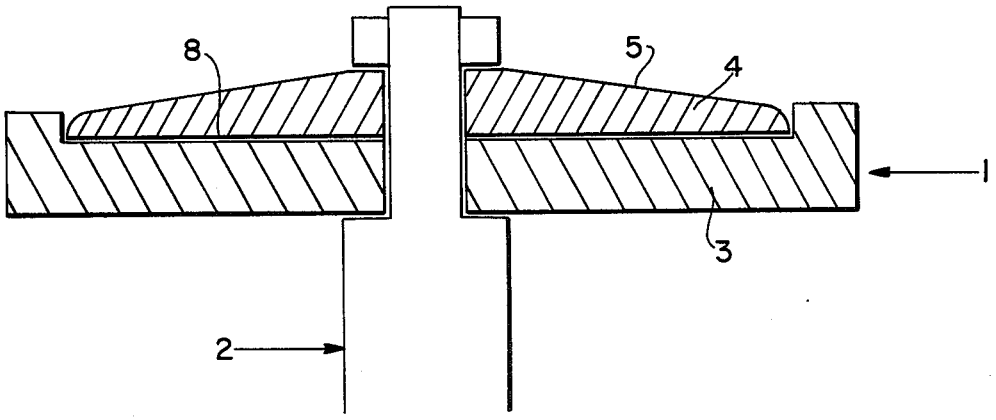

In FIG. 3, the assembly comprises a target 1 fixed to a rod 2. The support for the target is formed by a part 3 of carbon/carbon composite in the form of a dish in which the part 4 of polycrystalline graphite is disposed. The refractory metal 5 is fixed on the part 4. Thermal contact between the two parts is provided by a braze or a metal in powder form, or graphite in powder form, or by a flexible graphite sheet (reference 8).

Figure 4:
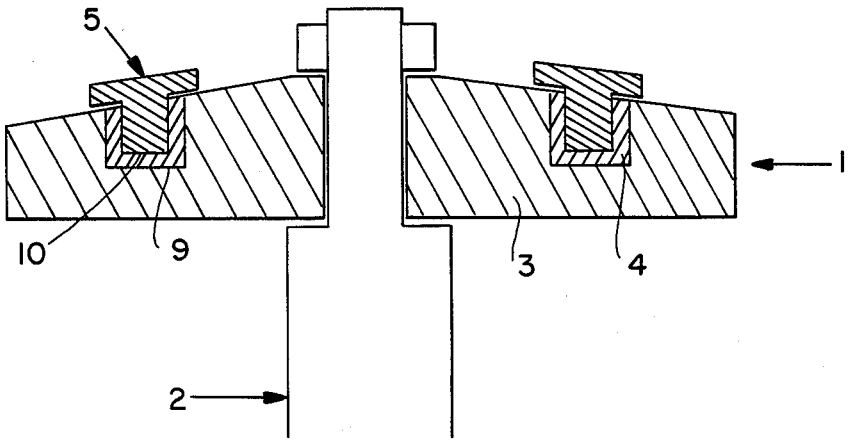

In FIG. 4, the assembly comprises a target 1 fixed to a rod 2. The support for the target is formed by a part 3 of carbon/carbon composite into which an annular dish 4 of polycrystalline graphite is embedded. The refractory metal at 5 which is itself annular in shape is embedded in the ring 4.

The mechanical and thermal connections between carbon/carbon composite and polycrystalline graphite, and between polycrystalline graphite and refractory metal, are made for example by brazing (references 9 and 10 respectively).

Figure 5:
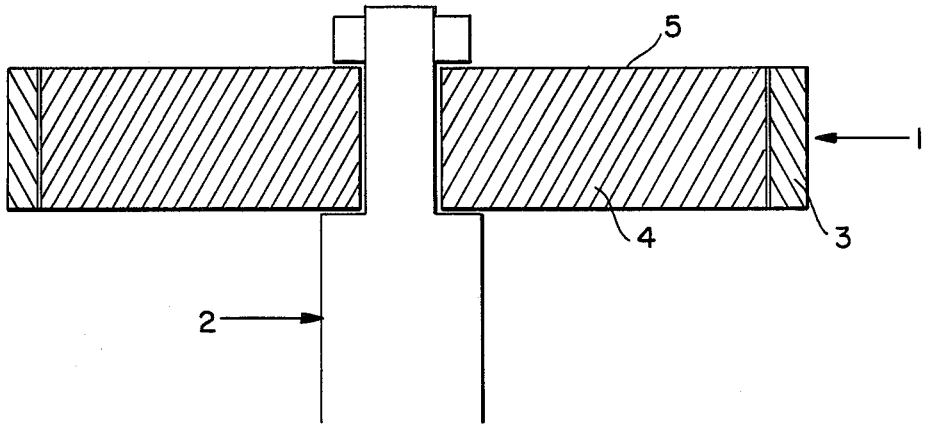

In FIG. 5, the assembly comprises a target 1 fixed to a rod 2. The support for the target is formed by a part 3 of carbon/carbon composite surrounding a flat disc 4 of polycrystalline graphite. The refractory metal at 5 is fixed on the part 4. The two parts are secured together by hooping.

In the assemblies illustrated in FIGS. 1, 2 and 3, for a defined target geometry, the thickness of the part made of polycrystalline graphite, which carries the refractory metal, is at a minimum and the thickness of the part of carbon/carbon composite is at a maximum.

Thus for example, with thicknesses of polycrystalline graphite of the order of 2 to 8 mm, the thicknesses of carbon/carbon composite are of the order of 10 to 20 mm.

The thickness of the refractory metal generally varies depending on whether it is fixed by brazing or deposited by chemical vapour phase deposition. In the former case, it is of the order of 3 to 8 mm while in the second case it is of the order of 0.4 to 1 mm.

The following example which is given by way of non-limiting example shows the full attraction of the invention.

EMBODIMENT

A series of supports for anticathodes as shown in FIG. 3 was produced. Each support is 120 mm in diameter while the maximum thickness of the polycrystalline graphite part is 8 mm and the thickness of the carbon/-carbon composite part is 15 mm.

The polycrystalline graphite, of composition 1116 PT, from the present applicants, is of the following characteristics:

| | |
|---|---|
| density | 1.82 g/cm$^3$ |
| resistance to bending | 65 MPa |
| resiliency | 1500 N.m$^{-1}$ |
| coefficient of expansion | $5.5 \times 10^{-6}$°C.$^{-1}$ between 20 and 1500° C. |

The carbon/carbon composite is an AEROLOR (the present applicants' registered trademark), AEROLOR 22 which is of the following characteristics:

| | |
|---|---|
| density | 1.75 g/cm$^3$ |
| resistance to bending | 180 MPa |
| resiliency | 15,000 N.m$^{-1}$ |
| coefficient of expansion | $1.8 \times 10^{-6}$°C.$^{-1}$ between 20 and 1500° C. |

Thermal contact between the two parts is produced by a zirconium braze as described in patent FR-A-1 249 498.

The part of polycrystalline graphite of half the supports is coated by chemical vapour phase deposition with a layer of tungsten which is 1.0 mm in thickness.

The supports, whether coated or not, are subjected to a bursting test and the results obtained are compared to those obtained with conventional supports of polycrystalline graphite alone, which are or are not coated with the same thickness of tungsten.

All the results obtained are set forth in following Table 1:

| | Uncoated support according to the invention | Uncoated conventional support of polycrystalline graphite |
|---|---|---|
| Bursting speed in revolutions/min | Between 37,000 and 40,000 | Between 22,000 and 25,000 |
| | Support according to the invention coated with 1 mm of tungsten | Conventional support of polycrystalline graphite coated with 1 mm of tungsten |
| Bursting speed in revolutions/min | Between 31,000 and 34,000 | Between 18,000 and 21,000 |

By taking the average of those results, it is found that:

the bursting speed of a support according to the invention, which is uncoated, is of the order of 39,000 rpm while that of a conventional uncoated support is of the order of 24,000 rpm;

the bursting speed of a support according to the invention coated with 1 mm of tungsten is of the order of 32,000 rpm while that of a conventional support also coated with 1 mm of tungsten is of the order of 19,000 rpm.

That finding demonstrates the full attraction of the invention.

What is claimed is:

1. A rotary target for an X-ray tube comprising:

a support comprising:

a first part comprising a carbon-carbon composite comprising carbon fibers and a carbon matrix;

a second part comprising a polycrystalline graphite; and mechanical and thermal joint means disposed between said first and second parts, so that said first and second parts are mechanically fixed relative to each other and are in thermal contact, said thermal joint means comprising a brazed joint, a vapor phase carbon infiltration joint, a joint formed from metal or graphite in powder form, or a joint formed of a flexible sheet of graphite; and a refractory metal coating on said second part.

2. A support for a rotary target for an X-ray tube, comprising:

a first part comprising a carbon-carbon composite comprising carbon fibers and a carbon matrix;

a second part comprising a polycrystalline graphite and mechanical and thermal joint means disposed between said first and second parts, so that said first and second parts are mechanically fixed relative to each other and are in thermal contact, said thermal joint means comprising a brazed joint, a vapor phase carbon infiltration joint, a joint formed from metal or graphite in powder form, or a joint formed of a flexible sheet of graphite.

3. A support according to claim 2 wherein the first and second parts are mechanically fixed together by a groove-and-tongue type connection.

4. A support according to claim 2 wherein the first and second parts are mechanically fixed together by interembedding.

5. A support according to claim 2, 3 or 4 wherein the thickness of the part of carbon/carbon composite is greater than that of the part of polycrystalline graphite.

6. A support according to claim 2, wherein the first part of carbon/carbon composite surrounds the second part of polycrystalline graphite, in a belt-like manner.

7. A support according to claim 6 wherein the first and second parts are fixed together by hooping.

8. A support according to claim 2, wherein the thermal joint means is a brazed joint.

9. A support according to claim 2, wherein the thermal joint means is a vapour phase carbon infiltration joint.

* * * * *